United States Patent [19]

Mishra et al.

[11] Patent Number: 4,639,402

[45] Date of Patent: Jan. 27, 1987

[54] PHOTORECEPTOR CONTAINING SELENIUM PARTICLES COATED WITH A REACTION PRODUCT OF A HYDROLYZED SILANE

[75] Inventors: Satchidanand Mishra; Leon A. Teuscher, both of Webster, N.Y.

[73] Assignee: Xerox Corporation, Stamford, Conn.

[21] Appl. No.: 761,931

[22] Filed: Aug. 2, 1985

[51] Int. Cl.[4] ..... G03G 5/087

[52] U.S. Cl. ..... 430/58; 430/84; 430/129

[58] Field of Search ..... 430/135, 84, 58, 129

[56] References Cited

U.S. PATENT DOCUMENTS

| | | | |
|---|---|---|---|
| 2,663,636 | 12/1953 | Middleton | 430/135 |
| 3,155,504 | 11/1964 | Damm et al. | 430/87 |
| 3,197,307 | 7/1965 | Blake et al. | 430/87 |
| 3,467,603 | 9/1969 | Brown et al. | 430/135 |
| 3,607,363 | 9/1971 | Sadamatso et al. | 430/135 |
| 3,867,139 | 2/1975 | Yamada et al. | 430/135 |
| 4,232,102 | 11/1980 | Horgan et al. | 430/58 |
| 4,464,450 | 8/1984 | Teuscher | 430/59 |

*Primary Examiner*—John L. Goodrow
*Attorney, Agent, or Firm*—Peter H. Kondo

[57] ABSTRACT

An electrostatographic imaging member comprising a photoconductive layer comprising an organic resin binder and photoconductive particles comprising selenium coated with thin layer of a reaction product of a hydrolyzed aminosilane. This electrostatographic imaging member may be prepared by forming a mixture of an organic resin binder, the photoconductive particles coated with a thin layer of a reaction product of a hydrolyzed aminosilane and a solvent for the binder to form a uniform dispersion, forming the dispersion into a uniform layer, and drying the uniform layer to form a photoconductive layer.

15 Claims, No Drawings

PHOTORECEPTOR CONTAINING SELENIUM PARTICLES COATED WITH A REACTION PRODUCT OF A HYDROLYZED SILANE

BACKGROUND OF THE INVENTION

This invention relates in general to xerography and more specifically to a novel photoreceptor and process for preparing and using the photoreceptor.

Vitreous and amorphous selenium photoconductive materials have enjoyed wide use in reusable photoconductors in commercial xerography. However, the spectral response of these materials is limited largely to the blue-green portion of the visible spectrum, i.e. below 5200 Angstrom units.

Selenium also exists in a crystalline form known as trigonal or hexagonal selenium. Trigonal selenium is well known in the semiconductor art for use in the manufacture of selenium rectifiers.

In the past, trigonal selenium was not normally used in xerography as a photoconductive layer because of its relatively high electrical conductivity in the dark, although in some instances, trigonal selenium can be used in a binder configuration in which the trigonal selenium particles are dispersed in a matrix of another material such as an electrically active organic material or vitreous selenium.

It is also known that a thin layer of trigonal selenium overcoated with a relatively thick layer of electrically active organic material, forms a useful composite photosensitive member which exhibits improved spectral response and increased sensitivity over conventional vitreous selenium-type photoreceptors. This device and method are described, for example, in U.S. Pat. No. 3,961,953 to Millonzi et al.

It is also known that when using trigonal selenium, whether it be dispersed in a binder or used as a generation material in a composite photoconductor device, the trigonal selenium exhibits a high dark decay after the photoreceptor has been cycled in a xerographic process. This is referred to as fatigued dark decay. Also, after cycling the photoreceptor in a xerographic process, the photoreceptor will not accept as much charge as it did initially. Fatigued dark decay is the dark decay observed after a photoreceptor has completed at least one xerographic cycle, is erased and recharged.

A process for controlling dark decay by treatment of trigonal selenium is described in U.S. Pat. No. 4,232,102 to Horgan et al. The process provides treated trigonal selenium for photosensitive devices with improved cyclic charge acceptance and control and also improved dark decay both initially and after cycling an imaging member in a xerographic process. The treatment process involves, for example, swirling washed trigonal selenium in a 0.6 normal (N) solution of sodium hydroxide for one-half hour and then allowing the solids to settle out and remain in contact with the sodium hydroxide solution for 18 hours. The supernatent liquid is decanted and retained and the treated trigonal selenium is filtered with filter paper. The retained supernatent liquid is used to rinse the breaker and funnel. The trigonal selenium is then dried at 60° C. in a forced air oven for 18 hours. The total sodium selenite and sodium carbonate levels in the resulting mixture average approximately 1.0 percent by weight on an approximately equimolar basis based on the weight of the trigonal selenium.

Although very good results may be achieved with the specific process described in U.S. Pat. No. 4,232,102, the 18 hours utilized for contacting the trigonal selenium with sodium hydroxide and the 18 hours employed for forced air drying are time consuming. Moreover, the sodium content of the final treated trigonal selenium cannot be accurately predicted and the sodium content of the final treated trigonal selenium can vary as much as 52% from the lowest weight percent sodium content to the highest weight percent sodium content Further, undesirable absorption of water occurs during storage prior to incorporation of the sodium doped selenium into a photosensitive device.

Another process for controlling dark decay by treatment of trigonal selenium is described in copending U.S. patent application Ser. No. 557,498, entitled "PROCESS", filed Dec. 1, 1983 in which an electrostatographic photosensitive device is prepared by combining a sodium additive comprising sodium carbonate, sodium bicarbonate, sodium selenite, sodium hydroxide or mixtures thereof with trigonal selenium particles, an organic resin binder and a solvent for the binder to form a milling mixture, milling the milling mixture to form a uniform dispersion and applying the dispersion to a substrate in an even layer and drying the layer. The sodium additive may be added to form the milling mixture as an anhydrous salt or in a concentrated aqueous solution. If the sodium additive is in the form of a concentrated aqueous solution, it should contribute to the milling mixture less than about 20 percent by weight water based on the total weight of the trigonal selenium. The milling mixture is milled until a uniform dispersion of trigonal selenium particles having an average particle size of between about 0.01 micrometer and about 5 micrometers is formed.

Although very good results may be achieved with the specific process described in the aforesaid copending U.S. patent application Ser. No. 557,498, the process requires the presence of a sodium compound which can eventually cause the pitting and eventual loss of metal ground planes such as aluminum ground planes when the photoreceptor is cycled many thousands of cycles under high huimidity conditions. Pitting can result in black spots in the background areas of copies and loss of the ground plane is manifested by an inability of the photoreceptor to form a toner image.

OBJECTS OF THE INVENTION

It is, therefore, an object of this invention to provide a novel process for preparing an electrostatographic photosensitive device which overcomes the above-noted disadvantages.

It is a further object of this invention to provide an improved process to treat trigonal selenium so as to control dark decay.

It is a further object of this invention to provide an improved process to treat trigonal selenium so as to enhance cyclic stability.

It is a further object of this invention to provide a more energy and time efficient process utilizing fewer steps to treat trigonal selenium so as to control dark decay.

It is a further object of this invention to provide a process which improves the dispersion of trigonal selenium in a binder.

It is a further object of this invention to eliminate the need for doping trigonal selenium with sodium.

SUMMARY OF THE INVENTION

The foregoing objects and others are accomplished in accordance with this invention by providing an electrostatographic imaging member comprising a substrate and a photoconductive layer comprising an organic resin binder and photoconductive particles coated with a reaction product of a hydrolyzed aminosilane. The hydrolyzed silane has the general formula:

I

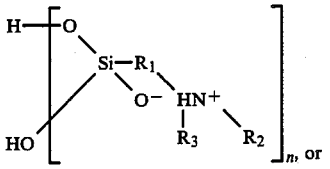

II

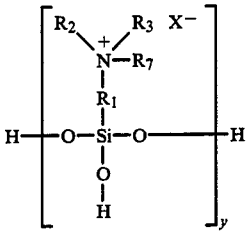

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4. The electrostatographic imaging member may be prepared by forming a uniform dispersion mixture of an organic resin binder, photoconductive particles coated with a reaction product of the hydrolyzed silane and a solvent for the binder, applying the dispersion to a substrate in an even coating, and drying the coating to form a photoconductive layer.

The hydrolyzed silane may be prepared by hydrolyzing an aminosilane having the following structural formula:

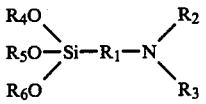

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable aminosilanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylhexoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)-propyltriethoxysilane, or mixtures thereof because the hydrolized solutions of these materials exhibit a greater degree of basicity and stability and because these materials are readily available commercially.

If $R_1$ is extended into a long chain, the compound becomes less stable. Silanes in which $R_1$ contains about 3 to about 6 carbon atoms are preferred because the oligomer is more stable. Optimum results are achieved when $R_1$ contains 3 carbon atoms. Satisfactory results are achieved when $R_2$ and $R_3$ are alkyl groups. Optimum stable solutions are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate structure:

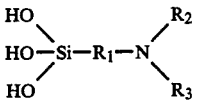

After drying, the reaction product layer formed from the hydrolyzed silane contains larger molecules in which n is equal to or greater than 6. The reaction product of the hydrolyzed silane may be linear, partially crosslinked, a dimer, a trimer, and the like.

In the process specifically described in U.S. Pat. No. 4,232,102, it has been found that the presence of sodium caused water absorption during storage of sodium doped photoreceptors and that the process described in U.S. patent application Ser. No. 557,498, filed Dec. 1, 1983 eliminated such presence of sodium during storage while providing relatively stable and predictable electrical properties and significantly reduced the processing time. The entire disclosures of this patent and patent application are incorporated herein in by reference in their entirety. The relative quantity of water in the milling mixture in the process described in U.S. patent application Ser. No. 557,498 may be significantly less than that disclosed in U.S. Pat. No. 4,232,102 and can even be omitted. Moreover, the process of U.S. patent application Ser. No. 557,498 eliminated variations in sodium content of doped milling mixtures and prevented trigonal selenium from exhibiting unacceptable and undesirable values of dark decay either before charging or discharging the member or after the member has been cycled through a complete xerographic process, that is, charged and erased and then re-charged in the dark.

Although good results may be achieved with the process of U.S. patent application Ser. No. 557,498, filed Dec. 1, 1983, doping of trigonal selenium with sodium was still required. The disadvantages of having sodium dopant present in the photoconductive layer include pitting and eventual loss of metal ground planes such as aluminum ground planes when the photoreceptor is cycled many thousands of cycles under high humidity conditions. Pitting can result in black spots in the background areas of copies and loss of the ground plane is manifested by an inability of the photoreceptor to form a toner image.

The photoreceptor of the instant invention need not contain the sodium utilized in the photoreceptors described in U.S. Pat. No. 4,232,102 and U.S. patent application Ser. No. 557,498, filed Dec. 1, 1983. Thus, the photoreceptor of the instant invention may comprise a substrate and a photoconductive layer comprising an organic resin binder and photoconductive particles coated with the reaction products of the hydrolyzed silanes described above, the photoconductive particles coated with the hydrolyzed silanes being substantially free of sodium dopant.

The hydrolyzed silane solution utilized to prepare the photoreceptor of instant invention may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the selenium pigment or particles. The thickness of the reaction product layer is estimated to be between about 20 Angstroms and about 2,000 Angstroms.

A solution pH between about 4 and about 14 is preferred because dark decay is minimized. Optimum reaction product layers on the pigment are achieved with hydrolyzed silane solutions having a pH between about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluoriosilicic acid, Bromocresol Green, Bromophenol Blue, p-toluene sulphonic acid and the like.

If desired, the aqueous solution of hydrolyzed silane may also contain additives such as polar solvents other than water to promote improved wetting of the selenium pigment particles. Improved wetting ensures greater uniformity of the final siloxane layer and more predictable humidity sensitivity characteristics. Any suitable polar solvent other than water may be employed. Typical polar solvents include methanol, ethanol, isopropanol, tetrahydrofuran, methoxyethanol, ethoxyethanol, ethylacetate, ethylformate and mixtures thereof. Optimum wetting is achieved with ethanol as the polar solvent additive at room temperature. Generally, the amount of polar solvent added to the hydrolyzed silane solution is less than about 95 percent based on the total weight of the solution.

Any suitable technique may be utilized to treat the photoconductive particles with the reaction product of the hydrolyzed silane. For example, washed trigonal selenium can be swirled in a hydrolyzed silane solution for between about 1 minute and about 60 minutes and then the solids thereafter allowed to settle out and remain in contact with the hydrolyzed silane for between about 1 minute and about 60 minutes. The supernatent liquid may then be decanted and retained and the treated trigonal selenium filtered with filter paper. The retained supernatent liquid may be used to rinse the beaker and funnel. The trigonal selenium may be dried at between about 1 minute and about 60 minutes at between about 80° C. and about 135° C. in a forced air oven for between about 1 minute and about 60 minutes. Since the filtered and dried doped trigonal selenium is normally stored for future processing, dried sodium doped trigonal selenium would normally absorb varying amounts of water which render less certain any attempt to predict the electrical and other properties of the final product whereas trigonal selenium substantially free of sodium and treated with the hydrolyzed silane solution of this invention does not absorb any significant amounts of water during storage for future processing. The expression "substantially free of sodium" is entended to mean trigonal selenium containing less than about 60 parts per million sodium. Trigonal selenium may contain trace amounts of sodium after refining but the amount of sodium present is normally less than about 60 parts per million.

The hydrolyzed silane material may be applied to trigonal selenium, for example, during the multi-step process described in U.S. Pat. No. 4,232,102 involving swirl washing, contact soaking, decanting, filtering, drying, and storing.

Satisfactory results may be achieved when the binder solution formulation contains from about 1 percent by weight to about 20 percent by weight polymer. Polymer solution concentrations higher than about 20 percent tend to become too viscous for efficient milling. A typical binder solution formulation consists of a solution of about 20 percent by weight polymer and about 80 percent by weight nonaqueous solvent. Sufficient binder is normally employed to disperse the trigonal selenium particles for milling. Additional binder may be added after milling but prior to coating to ensure that a coherent dried binder layer. Factors that should be considered in selecting the amount of solvent to be used for the milling mixture include coating drying time, viscosity of the binder, milling time and the like. Typical combinations of suitable binder and solvent combinations include poly-N-vinylcarbazole and tetrahydrofuran/toluene; poly-N-vinylcarbazole and methyl ethyl ketone/toluene; poly(hydroxyether) resin (PKHH, available from Union Carbide Corporation) and methyl ethyl acetone/methyl ethyl ketone; and the like. The binder solvent should be non-aqueous and chemically inert with respect to the oligomeric silane additive present.

The milling mixture is milled by any suitable means until a uniform dispersion of trigonal selenium particles having an average particle size of between about 0.01 micrometer and about 5 micrometers is formed. Typical milling means include attritors, ball mills, sand mills, vibrating mills, jet micronizers and the like. The time desired for milling depends upon factors such as the efficiency of the milling means employed. Satisfactory results may be achieved with a starting size of between about 0.5 micrometer and about 10 micrometers. It is important, however, that the trigonal selenium particles be milled long enough to achieve an average particle size diameter of between about 0.01 micrometer and about 5 micrometers and a reduction in size of the trigonal selenium particles by a factor of between about 2 and about 50. Preferably, the milled particulate trigonal selenium should be in the size range from about 0.03 micrometer to 0.5 micrometer in diameter. The size range and size reduction factor are important in that the trigonal selenium will have a sufficiently high freshly created surface to volume ratio to achieve effective doping. This will control the surface component of dark decay. Excellent results are achieved with milling times of between about 96 hours and about 140 hours with a laboratory ball mill and an average starting trigonal selenium particle size between about 0.5 micrometer and about 5 micrometers.

The preferred size of the particulate trigonal selenium pigment to be dispersed in the binder is from about 0.01 micrometer to about 5 micrometers in diameter. The most preferred size of the trigonal selenium particles is from about 0.03 micrometer to about 0.5 micrometer in diameter for better light absorption and xerographic performance.

The milled mixture may be applied to a substrate and dried by any suitable well known, conventional technique. Typical coating processes include spraying, bar coating, wire wound rod coating, dip coating and the like. Typical drying techniques include oven drying, radiant heat drying, forced air drying and the like.

Although trigonal selenium is described in the specific embodiments throughout this disclosure, other suitable selenium photoconductive particles may be substituted for trigonal selenium. Other typical selenium photoconductive particles include amorphous selenium, selenium alloys, arsenic triselenide, and the like and mixtures thereof.

The binder layer contains the trigonal selenium particles treated with the reaction product of the hydrolyzed silane in an amount of from about 200 parts per million to about 7 percent by weight reaction product of the hydrolyzed silane based on the weight of the trigonal selenium. When less than about 200 parts per million reaction product of the hydrolyzed silane based on the weight of the trigonal selenium is present on the selenium particles in the dried binder layer, the generator binder layer begins to behave like untreated selenium particles in the binder layer. When more than about 7 percent of the reaction product of the hydrolyzed silane based on the weight of the trigonal selenium is present in the dried binder layer, the binder layer becomes unduly xeographically insensitive. Satisfactory results may be achieved when the thickness of the substantially continuous coating of the reaction product of the hydrolyzed silane on the photoconductive particles is between about 20 Angstroms and about 2,000 Angstroms. Preferably, the thickness of the substantially continuous coating of the reaction product of the hydrolyzed silane on the photoconductive particles is between about 50 Angstroms and about 500 Angstroms. Optimum results are realized when the thickness of the coating is between about 100 Angstroms and about 200 Angstroms. At siloxane coating thicknesses greater than about 2,000 Angstroms, dark decay decreases and background significantly increases. For example, a low background potential of about 100 volts has been observed for a photoreceptor in which the combined thickness of the charge generator layer and the charge transport layer was about 27 micrometers, the initial charging potential was about 750 volts, and the siloxane coating thicknesses on trigonal selenium particles was about 100 Angstroms.

Humidity sensitivity, pitting of aluminum conductive layers and reduced adhesion of the binder layer approaches can be eliminated with trigonal selenium particles treated with the reaction product of the hydrolyzed silane of this invention because sodium doping can be totally eliminated. The treated trigonal selenium particles may be randomly dispersed without orientation in the binder layer.

Typical applications of the photoconductive particles coated with a reaction product of the hydrolyzed silane include, as mentioned above, a single photoconductive layer having trigonal selenium in particulate form coated with the reaction product of the hydrolyzed silane in an organic resin binder. This may be used as the photosensitive device itself. Another typical application of the product of the invention includes a photosensitive member which has at least two operative layers. The first operative layer comprises the abovementioned single photoconductive layer. This layer is capable of photogenerating charge carriers and injecting these photogenerated charge carriers into a contiguous or adjacent charge carrier transport layer. The second operative layer is a charge carrier transport layer which may comprise a transparent organic polymer or a non-polymeric material which when dispersed in an organic polymer results in the organic polymer becoming active, i.e. capable of transporting charge carriers. The charge carrier transport material should be substantially non-absorbing to visible light or radiation in the region of intended use, but which is "active" in that it allows the injection of photogenerated charge carriers, e.g. holes, from the particular trigonal selenium layer and allows these charge carriers to be transported through the active layer to selectively discharge the surface charge on the free surface of the active layer.

The active materials need not be restricted to those which are transparent in the entire visible wavelength region. For example, when used with a transparent substrate, imagewise exposure may be accomplished through the substrate without the light passing through the layer of active material, i.e. charge transport layer. In this case, the active layer need not be non-absorbing in the wavelength region of use. Other applications where complete transparency is not required for the active material in the visible region include a selective recording of narrow band radiation such as emitted from lasers, spectral pattern recognition and possible functional color xerography, such as color coded form duplication.

The photoconductive particles coated with a reaction product of the hydrolyzed silane of the instant invention may be also used in an imaging member having a first layer of electrically active charge transport material carried on a supporting surface and a photoconductive layer of the instant invention overlying the active layer as described in U.S. Pat. No. 4,346,158, the entire disclosure of which is incorporated herein by reference. If desired, a second layer of electrically active charge transport material may be applied to the photoconductive layer. This latter member is more fully described in U.S. Pat. No. 3,953,207, the entire contents of which are incorporated herein by reference.

The imaging member containing the photoconductive particles coated with a reaction product of the hydrolyzed silane and binder may comprise a supporting substrate layer having the binder layer thereon. The substrate preferably comprises any suitable conductive material. Typical conductive materials comprise aluminum, steel, nickel, brass, titanium or the like. The substrate may be rigid or flexible and of any convenient thickness. Typical substrates include flexible belts or sleeves, sheets, webs, plates, cylinders and drums. The substrate or support may also comprise a composite structure such as a thin conductive coating on a paper base; a plastic web coated with a thin conductive layer such as aluminum, nickel or copper iodine; or glass coated with a thin conductive coating of chromium or tin oxide.

A charge blocking layer and or adhesive layer may be employed between the substrate and the charge generation layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. The entire disclosure of U.S. Pat. No. 4,464,450 is incorporated herein by reference. The specific silanes employed to form the preferred blocking layer are identical to the silanes employed to treat the trigonal selenium particles of this invention. In other words, silanes having the following structural formula:

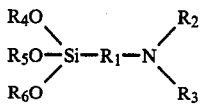

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylhexoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluoriosilicic acid, Bromocresol Green, Bromophenol Blue, p-toluene sulphonic acid and the like.

Any suitable technique may be utilized to apply the hydrolyzed silane solution to the conductive layer. Typical application techniques include spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms.

If desired, any suitable adhesive layer may be employed between the photoconductive binder layer and the conductive layer or between the photoconductive binder layer and the blocking layer. Typical adhiesive layers include film forming polymers such as polyester, polyvinyl butral, polyvinylpyrolidone, and the like.

In addition, if desired, the substrate or support may be eliminated. In this case, the charge may be placed upon the photoconductive imaging member by double corona charging techniques well known and disclosed in the prior art. Other modifications using no substrate at all include placing the imaging member of a conductive backing member or plate during charging of the surface while in contact with the backing member. Subsequent to imaging, the imaging member may then be stripped from the conductive backing.

Binder material for the binder layer may comprise any suitable electrically insulating resin such as those disclosed in Middleton et al, U.S. Pat. No. 3,121,006, the entire contents of which are incorporated herein by reference. The binder material may also comprise Saran, available from Dow Chemical Company, which is a copolymer of a polyvinylchloride and polyvinylidenechloride; polystyrene polymers; polyvinylbutyral polymers and the like. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. The thickness of the binder layer is not critical. Layer thicknesses from about 0.05 micrometer to about 40.0 micrometers have been found to be satisfactory.

Satisfactory results may be achieved with an amount of from about 200 parts per million to about 7 percent by weight reaction product of the hydrolyzed silane based on the weight of the trigonal selenium. The most preferred total amount of these materials is such that the reaction product of the hydrolyzed silane content is between about 400 parts per million and about 2.4 percent by weight based on the weight of the trigonal selenium in the photoconductive layer when using electrically active binders such as poly-N-vinylcarbazole. However, this amount may vary if binders, such as electrically inactive binders, are used.

The active charge transport layer may comprise any suitable transparent organic polymer or non-polymeric materials capable of supporting the injection of photogenerated holes and electrons from the trigonal selenium binder layer and allowing the transport of these holes or electrons through the organic layer to selectively discharge the surface charge.

Polymers having this characteristics, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active layer not only serves to transport holes or electrons, but also protects the photoconductive layer from abrasion or chemical attack and therefor extends the operating life of the photoreceptor imaging member. The charge transport layer will exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active material need not be absorbing in the wavelength region of use. The active layer in conjunction with the generation layer in the instant invention is a material which is an insulator to the extent that an electrostatic charge placed on the active transport layer is not conductive in the absence of illumination, i.e. a rate sufficient to prevent the formation and retention of an electrostatic latent image thereon.

In general, the thickness of the active layer should be from about 5 to about 100 micrometers, but thicknesses outside this range can also be used. The ratio of the thickness of the active layer to the charge generation layer should be maintained from about 2:1 to 200:1 and in some instances as great as 400:1. However, ratios outside this range can also be used.

The active layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

A dielectric layer e.g. an organic polymer, may be deposited on the dispersed trigonal selenium layer. Many imaging methods can be employed with this type of photoconductor. Examples of these methods are described by P. Mark in Photographic Science and Engineering, Vol. 18, No. 3, pp. 254–261, May/June 1974

These imaging methods require the injection of majority carriers or photoconductors possessing ambipolar properties. Also, such methods may require a system where bulk absorption of light occurs.

In all of the above charge transport layers, the activating compound which renders the electrically inactive polymeric material electrically active should be present in amounts of from about 15 to about 75 percent by weight.

The preferred electrically inactive resin materials are polycarbonate resins have a molecular weight from about 20,000 to about 100,000, more preferably from about 50,000 to about 100,000. The materals most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company.

Alternatively, as mentioned, the active layer may comprise a photogenerated electron transport material, for example, trinitrofluorenone, poly-N-vinyl carbazole/trinitrofluorenone in a 1:1 mole ratio, and the like.

At high relative humidities, layers containing sodium derivatives tend to cause pitting which is believed to be due to a reaction of the sodium with reactive underlying metal substrates such as aluminum. Elimination of sodium from trigonal selenium obviates this effect. The process of this invention provides a simpler, more effective technique to control dark decay of binder layers. This process also provides a means to fine tune the shape of the photo induced discharge curve which governs copy quality.

DESCRIPTION OF PREFERRED EMBODIMENTS

The following examples further define, describe and compare exemplary methods of preparing the trigonal selenium of the present invention. Parts and percentages are by weight unless otherwise indicated. The examples, other than any control examples, are also intended to illustrate the various preferred embodiments of the present invention.

EXAMPLE I

An aqueous solution was prepared containing about 0.44 percent by weight based on the total weight of the solution (0.002 mole solution), of 3-aminopropyl triethoxylsilane. The solution also contained about 95 percent by weight denatured ethanol and about 5 percent by weight isopropanol based on the total weight of the solution. This solution has a pH of about 10 and was applied with a 0.0005 Bird applicator onto the surface of a 127 micrometer thick aluminized polyester film substrate (Mylar available from E. I. duPont de Nemours & Co.) and thereafter dried at a temperature of about 135° C. in a forced air oven for about 3 minutes to form a reaction product layer of the partially polymerized silane upon the aluminum oxide layer of the aluminized polyester film to form a dried layer having a thickness of about 150 Angstroms measured by infrared spectroscopy and by ellipsometry. In a glove box with the humidity less than 20 percent and the temperature at 28° C., the substrate was coated with a layer of 0.5 percent duPont 49,000 adhesive in methylene chloride and trichloroethane, 4 to 1 volume, with a Bird applicator to a wet thickness of about 12.7 micrometers. The resulting interface layer was allowed to dry in a glove box for about 1 minute and in an oven for about 10 minutes at 100° C.

A milling mixture suspension was prepared by dissolving 0.8 gram of purified poly-N-vinylcarbazole in 14 grams of a 50:50 by weight mixture of tetrahydrofuran and toluene and thereafter adding 0.8 gram of trigonal selenium particles (prepared by the process described in Example I of U.S. Pat. No. 4,232,102) to form a milling mixture suspension. These trigonal selenium particles contain about 20 parts per million total sodium and less than 20 parts per million of other metal impurities and have an initial average particle size of about 1 micrometer. The suspension was milled in a laboratory ball mill comprising a 4 ounce glass jar containing 100 grams of stainless steel balls having an average diameter of about 3 millimeters. This mixture was milled in the ball mill for about 96 hours to form dispersed trigonal selenium particles having an average particle size of 0.05 micrometer. After milling, 0.36 gram of additional purified poly-N-vinylcarbazole dissolved in 7.5 grams of a 50:50 by weight mixture of tetrahydrofuran and toluene were added to the milled mixture. The mixture was stirred to achieve uniformity and applied to the above interface layer with a Bird applicator to form a wet layer. The coated member was annealed at 135° C. in a vacuum for 5 minutes in a forced air oven to form a layer having a dry thickness of 2 micrometers.

A charge transport layer was formed on this charge generator layer by applying a mixture of a 50—50 by weight solution of Markrolon, a polycarbonate resin having a molecular weight from about 50,000 to about 100,000 available from Farbenfabriken Bayer A. G., and N,N'-diphenyl-N,N'-bis(3-methylphenyl)-[1,1'-biphenyl]-4,4'-diamine dissolved in methylene chloride to give a 15 percent by weight solution. The components were coated on top of the generator layer with a Bird applicator and dried at temperature of about 135° C. in a forced air oven for about 5 minutes.

The trigonal selenium particles and generator layer were substantially free of sodium (i.e. contained less than about 60 ppm sodium based on the weight of the selenium) and were free of any silane or silane reaction product. This generator layer serves as a control for the Examples that follow.

Example II

The procedures of Example I were repeated except that the trigonal selenium particles were backwashed in an aqueous hydrolyzed silane solution. The aqueous hydrolyzed silane solution contained about 0.5 percent by weight 3-aminopropyl triethoxylsilane based on the total weight of the solution and about 95 percent by weight denatured ethanol and about 5 percent by weight isopropanol based on the total weight of the solution. This hydrolyzed silane solution had a pH of about 10. 100 grams of trigonal selenium having a particle size of about 1 micrometer was placed in a vessel and sufficient hydrolyzed silane solution was added to bring the volume to 1 liter. This mixture was swirled for 1 hour. The solids were allowed to settle out and remain in contact with the hydrolyzed silane solution for 1 hour. The supernatent liquid was decanted and retained and the trigonal selenium treated with the reaction product of the hydrolyzed silane was separated by filtering with No. 2 filter paper. The treated trigonal selenium was then dried at 60° C. in a forced air oven for 18 hours and introduced into a milling mixture suspension to prepare a photoreceptor as described in Example I.

The photoreceptor described in Examples I and II were secured to an aluminum cylinder 30 inches in diameter. The drum was rotated at a constant speed of 60 revolutions per minute resulting in a surface speed of 30 inches per second. Charging devices, exposure lights, erase lights, and probes were mounted around the periphery of the cylinder. The locations of the charging devices, exposure lights, erase lights, and probes were adjusted to obtain the following time sequence:

| | |
|---|---|
| Charging | 0.0 second |
| Voltage Probe 1 ($V_1$) | 0.06 second |
| Expose | 0.16 second |
| Voltage Probe 2 ($V_2$) | 0.22 second |
| Voltage Probe 4 ($V_4$) | 0.66 second |
| Erase | 0.72 second |
| Voltage Probe 5 | 0.84 second |
| Start of Next Cycle | 1.00 second |

The photoreceptor were rested in the dark for 15 minutes prior to charging. They were then negatively corona charged in the dark and the voltage measured at Voltage Probe 1 ($V_1$). The device was discharged (erased) 720 microseconds after charging by exposure to about 500 erg/cm$^2$ of light. Probe readings were taken after 10 cycles. The values of the probe readings were as follows:

| PHOTORECEPTOR | $V_1$ | $V_2$ | $V_4$ | $\frac{V_2 \cdot V_4 \times 100}{V_2}$ |
|---|---|---|---|---|
| Example I (control) (No silane) | 914 | 760 | 597 | 21% |
| Example II (control) (Backwashed with 0.5% silane) | 843 | 775 | 698 | 9% |

Dark decay, the reduction of surface voltage with time in the dark may be expressed as a percentage of the initial voltage by the formula:

$$\frac{V_2 \cdot V_4 \times 100}{V_2}$$

The employment of hydrolyzed silanes in Example II clearly demonstrates the difference in dark decay when compared to the control Example I. In other words, the dark decay of the control Example I was 133 percent greater than the dark decay of the photoreceptor of this invention.

Example III

The procedures of Example II were repeated using the same materials except that the concentration of the 3-aminopropyl triethoxylsilane was 0.1 percent based on the total weight of the solution.

Example IV

The procedures of Example II were repeated using the same materials except that the concentration of the 3-aminopropyl triethoxylsilane was 0.25 percent based on the total weight of the solution.

Example V

The procedures of Example II were repeated using the same materials except that the concentration of the 3-aminopropyl triethoxylsilane was 1 percent based on the total weight of the solution.

Example VI

The procedures of Example II were repeated using the same materials except that the concentration of the 3-aminopropyl triethoxylsilane was 2.5 percent based on the total weight of the solution.

Example VII

The photoreceptors described in Examples I through VI were cycled on a xerographic scanner as described in Example II. The data obtained are reported in Table 1 below. The photoinduced discharge data for the photoreceptors described in Examples I through VI are presented in Table 2 through 7, respectively.

TABLE 1

| Example | Silane Conc. Backwash Solution | Surface Potential (volts) V1 | Surface Potential (volts) V2 | Surface Potential (volts) V4 |
|---|---|---|---|---|
| 1 | 0% | 914 | 760 | 597 |
| 2 | 0.5 | 843 | 775 | 698 |
| 3 | 0.1 | 870 | 755 | 629 |
| 4 | 0.25 | 892 | 800 | 696 |
| 5 | 1.0 | 833 | 789 | 733 |
| 6 | 2.5 | 857 | 824 | 787 |

TABLE 1-continued

| Example | Percent Change $V_2 \cdot V_4$ Volts | Estimated Silane Coated $\frac{V_2 \cdot V_4 \times 100}{V_2}$ | Thickness (Angstroms) |
|---|---|---|---|
| 1 | 163 | 21 | 0 |
| 2 | 77 | 9 | 80 |
| 3 | 126 | 16 | 20 |
| 4 | 104 | 13 | 40 |
| 5 | 56 | 7 | 160 |
| 6 | 37 | 4 | 400 |

This table illustrates the dark decay (fatigued) of photoreceptors containing trigonal selenium both modified by hydrolized silane solutions of various concentrations (Examples II through VI) and unmodified (Example I). Charging density was $1 \times 10^{-3}$ Coulombs/m$^2$.

TABLE 2

(Example 1)
Photoinduced Discharge Data
No Backwashing of Selenium

| ERGS/cm$^2$ | Potential Volts |
|---|---|
| 0.1 | 640 |
| 0.2 | 624 |
| 0.4 | 584 |
| 0.6 | 544 |
| 0.8 | 496 |
| 1.0 | 480 |
| 2.0 | 280 |
| 3.0 | 168 |
| 4.0 | 96 |
| 5.0 | 80 |
| 6.0 | 72 |
| 7.0 | 64 |
| 8.0 | 60 |
| 9.0 | 56 |
| 10.0 | 50 |

This table illustrates the photoinduced discharge data for the photoreceptor of Example I containing unmodified trigonal selenium.

TABLE 3

(Example II)
Photoinduced Discharge Data
Backwashing Solution Concentration 0.5% By Weight

| ERGS/cm$^2$ | Potential Volts |
|---|---|
| 0.1 | 796 |
| 0.2 | 784 |
| 0.4 | 736 |
| 0.6 | 704 |
| 0.8 | 664 |
| 1.0 | 640 |
| 2.0 | 496 |
| 3.0 | 360 |
| 4.0 | 264 |
| 5.0 | 208 |
| 6.0 | 168 |
| 7.0 | 144 |
| 8.0 | 128 |
| 9.0 | 120 |
| 10.0 | 112 |

This table illustrates the photoinduced discharge data for the photoreceptor of Example II containing trigonal selenium backwashed with a 0.5 percent by weight silane solution.

TABLE 4

(Example III)
Photoinduced Discharge Data
Backwashing Solution Concentration 0.1% By Weight

| ERGS/cm$^2$ | Potential Volts |
|---|---|
| 0.1 | 752 |
| 0.2 | 704 |
| 0.4 | 680 |
| 0.6 | 640 |
| 0.8 | 624 |
| 1.0 | 592 |
| 2.0 | 400 |
| 3.0 | 248 |
| 4.0 | 160 |
| 5.0 | 120 |
| 6.0 | 104 |
| 7.0 | 80 |
| 8.0 | 72 |
| 9.0 | 72 |
| 10.0 | 64 |

This table illustrates the photoinduced discharge data for the photoreceptor of Example III containing trigonal selenium backwashed with a 0.1 percent by weight silane solution.

TABLE 5

(Example IV)
Photoinduced Discharge Data
Backwashing Solution Concentration 0.25% By Weight

| ERGS/cm$^2$ | Potential Volts |
|---|---|
| 0.1 | 768 |
| 0.2 | 752 |
| 0.4 | 704 |
| 0.6 | 668 |
| 0.8 | 632 |
| 1.0 | 600 |
| 2.0 | 448 |
| 3.0 | 332 |
| 4.0 | 208 |
| 5.0 | 168 |
| 6.0 | 128 |
| 7.0 | 104 |
| 8.0 | 96 |
| 9.0 | 88 |
| 10.0 | 80 |

This table illustrates the photoinduced discharge data for the photoreceptor of Example IV containing trigonal selenium backwashed with a 0.25 percent by weight silane solution.

TABLE 6

(Example V)
Photoinduced Discharge Data
Backwashing Solution Concentration 1.0% By Weight

| ERGS/cm$^2$ | Potential Volts |
|---|---|
| 0.1 | 808 |
| 0.2 | 800 |
| 0.4 | 760 |
| 0.6 | 728 |
| 0.8 | 688 |
| 1.0 | 648 |
| 2.0 | 504 |
| 3.0 | 400 |
| 4.0 | 320 |
| 5.0 | 256 |
| 6.0 | 224 |
| 7.0 | 216 |
| 8.0 | 184 |
| 9.0 | 168 |
| 10.0 | 160 |

This table illustrates the photoinduced discharge data for the photoreceptor of Example V containing trigonal selenium backwashed with a 1 percent by weight silane solution.

TABLE 7

(Example VI)
Photoinduced Discharge Data
Backwashing Solution Concentration 2.5% By Weight

| ERGS/cm$^2$ | Potential Volts |
|---|---|
| 0.1 | 808 |
| 0.2 | 800 |
| 0.4 | 760 |
| 0.6 | 736 |
| 0.8 | 680 |
| 1.0 | 656 |
| 2.0 | 512 |
| 3.0 | 400 |
| 4.0 | 360 |
| 5.0 | 256 |
| 6.0 | 224 |
| 7.0 | 192 |
| 8.0 | 184 |
| 9.0 | 172 |
| 10.0 | 160 |

This table illustrates the photoinduced discharge data for the photoreceptor of Example VI containing trigonal selenium backwashed with a 2.5 percent by weight silane solution.

Example VIII

The procedures of Example II were repeated using the same materials except that n-aminoethyl-3-aminopropyltrimethoxysilane was substituted for the 3-aminopropyl triethoxylsilane. The resulting photoreceptor exhibited substantially the same xerographic properties as the photoreceptor prepared in Example II.

Example IX

The procedures of Example II were repeated using the same materials except that (N,N'-dimethyl-3-amino)propyltriethoxysilane was substituted for the 3-aminopropyl triethoxylsilane. The resulting photoreceptor exhibited substantially the same xerographic properties as the photoreceptor prepared in Example II.

Example X

The procedures of Example II were repeated using the same materials except that the 3-aminopropyl triethoxylsilane was neutralized by adding acetic acid to the hydrolyed solution of silane. The pH of the solution was about 4. The resulting photoreceptor was cycled on a xerographic scanner as described in Example II. The data obtained are set forth in Table 8 below.

TABLE 8

Photoinduced Discharge Data
Backwashing Solution Concentration 0.5% With Equimolar Acid

| ERGS/cm$^2$ | Potential Volts |
|---|---|
| 0.1 | 792 |
| 0.2 | 776 |
| 0.4 | 728 |
| 0.6 | 648 |
| 0.8 | 640 |
| 1.0 | 608 |
| 2.0 | 440 |
| 3.0 | 320 |
| 4.0 | 232 |
| 5.0 | 192 |
| 6.0 | 160 |

TABLE 8-continued

| Photoinduced Discharge Data Backwashing Solution Concentration 0.5% With Equimolar Acid | |
|---|---|
| ERGS/cm$^2$ | Potential Volts |
| 7.0 | 144 |
| 8.0 | 136 |
| 9.0 | 120 |
| 10.0 | 112 |

This table illustrates the photoinduced discharge data for a photoreceptor containing trigonal selenium backwashed with a silane solution treated with acid.

Example XI

The procedures of Example III were repeated using the same materials except that the silane was neutralized by adding acetic acid to the hydrolyed solution of silane. The pH of the solution was about 4. The resulting photoreceptor was cycled on a xerographic scanner as described in Example II. The data obtained is set forth in Table 9 below.

TABLE 9

| Photoinduced Discharge Data Backwashing Solution Concentration 0.1% With Equimolar Acid | |
|---|---|
| ERGS/CM$^2$ | Potential Volts |
| 0.1 | 784 |
| 0.2 | 768 |
| 0.4 | 720 |
| 0.6 | 672 |
| 0.8 | 624 |
| 1.0 | 584 |
| 2.0 | 384 |
| 3.0 | 240 |
| 4.0 | 160 |
| 5.0 | 120 |
| 6.0 | 96 |
| 7.0 | 88 |
| 8.0 | 80 |
| 9.0 | 64 |
| 10.0 | 60 |

This table illustrates the photoinduced discharge data for a photoreceptor containing trigonal selenium backwashed with a silane solution treated with acid.

Example XII

The procedures of Examples VI were repeated using the same materials except that the the silane was neutralized by adding acetic acid to the hydrolyed solution of silane. The pH of the solution was about 4. The resulting photoreceptor was cycled on a xerographic scanner as described in Example II. The data obtained is set forth in Table 10 below.

TABLE 10

| Photoinduced Discharge Data Backwashing Solution Concentration 2.5% With Equimolar Acid | |
|---|---|
| ERGS/CM$^2$ | Potential Volts |
| 0.1 | 808 |
| 0.2 | 800 |
| 0.4 | 768 |
| 0.6 | 744 |
| 0.8 | 720 |
| 1.0 | 704 |
| 2.0 | 592 |
| 3.0 | 520 |
| 4.0 | 448 |
| 5.0 | 400 |
| 6.0 | 360 |

TABLE 10-continued

| Photoinduced Discharge Data Backwashing Solution Concentration 2.5% With Equimolar Acid | |
|---|---|
| ERGS/CM$^2$ | Potential Volts |
| 7.0 | 336 |
| 8.0 | 320 |
| 9.0 | 288 |
| 10.0 | 280 |

This table illustrates the photoinduced discharge data for a photoreceptor containing trigonal selenium backwashed with a silane solution treated with acid.

Example XIII

TABLE 11

| Fatigued Dark Decay in Photoreceptor with Pigment Backwashed with Silane Solutions Containing Equimolar Acid | | | | |
|---|---|---|---|---|
| Example | Silane Conc. Backwash Solution With Acid | Surface Potential (volts) V1 | Surface Potential (volts) V2 | Surface Potential (volts) V4 |
| 10 | 0.5% | 848 | 768 | 658 |
| 11 | 0.1% | 952 | 893 | 809 |
| 12 | 2.5% | 879 | 856 | 802 |

| Example | $V_2 \cdot V_4$ Volts | Percent Change $\frac{V_2 \cdot V_4 \times 100}{V_2}$ | Estimated Silane Coated Thickness (Angstroms) |
|---|---|---|---|
| 10 | 84 | 94 | 80 |
| 11 | 110 | 14 | 20 |
| 12 | 54 | 6 | 400 |

This table illustrates the dark decay data for the photoreceptors described in Examples X, XI and XII, respectively.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a photoconductive layer comprising an organic resin binder and photoconductive particles consisting essentially of selenium coated with a thin layer of a reaction product of a hydrolyzed aminosilane.

2. An electrostatographic imaging member according to claim 1 wherein said photoconductive particles consist essentially of trigonal selenium.

3. An electrostatographic imaging member according to claim 1 wherein said thin layer of a reaction product of a hydrolyzed aminosilane has a thickness between about 20 Angstroms and about 2,000 Angstroms.

4. An electrostatographic imaging member according to claim 1 including a charge transport layer overlying said photoconductive layer.

5. An electrostatographic imaging member according to claim 1 wherein said hydrolyzed aminosilane has the general formula selected from the group consisting of:

I

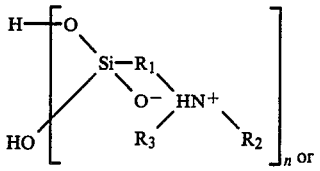

II.

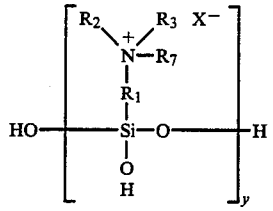

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 23 or 4, and y is 1,2,3 or 4.

6. An electrostatographic imaging member according to claim 1 wherein said hydrolyzed aminosilane has the general formula:

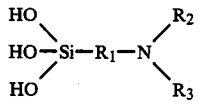

wherein $R_1$ is an alkylidene group containing 1 to 20 carbon atoms, and $R_2$ and $R_3$ are independently selected from the group consisting of H, a lower alkyl group containing 1 to 3 carbon atoms, a phenyl group and a poly(ethylene-amino)group.

7. A process for preparing electrostatographic imaging member comprising forming a mixture of an organic resin binder, photoconductive particles consisting essentially of selenium coated with a thin layer of a reaction product of a hydrolyzed aminosilane and a solvent for said binder to form a uniform dispersion, forming said dispersion into a uniform layer, and drying said uniform layer to form a photoconductive layer.

8. A process for preparing an electrostatographic imaging member according to claim 7 comprising forming said dispersion into a uniform layer by applying said dispersion to a substrate in an even coating, and drying said coating to form said photoconductive layer.

9. A process for preparing an electrostatographic imaging member according to claim 7 comprising combining an aqueous hydrolyzed aminosilane solution with photoconductive particles consisting essentially of trigonal selenium, separating said particles from said solution, drying said particles, combining said particles with an organic resin binder and a solvent for said binder to form a uniform dispersion, forming said dispersion into a uniform layer, and drying said layer to form a photoconductive layer.

10. A process for preparing an electrostatographic imaging member according to claim 9 including maintaining said aqueous hydrolyzed aminosilane solution at a pH between about 4 and about 14.

11. A process for preparing an electrostatographic imaging member according to claim 9 wherein said aqueous hydrolyzed aminosilane solution comprises from about 0.02 and about 7 percent by weight hydrolyzable aminosilane based on the total weight of said aqueous solution prior to hydrolyzing said aminosilane.

12. A process for preparing an electrostatographic imaging member according to claim 7 including applying a charge transport layer to said photoconductive layer.

13. A process for preparing an electrostatographic imaging member according to claim 7 wherein said hydrolyzed aminosilane has the general formula selected from the group consisting of:

I

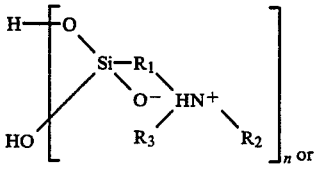

II.

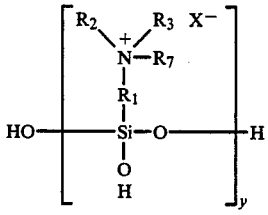

or mixtures thereof, wherein $R_1$ is an alkylidene group containing 1 to 20 carbon atoms, $R_2$, $R_3$, and $R_7$ are independently selected from the group consisting of H, a lower alkyl group containing 1 to 3 atoms and a phenyl group, X is a hydroxyl group or an anion of an acid or acidic salt, n is 1,2,3 or 4, and y is 1,2,3 or 4.

14. A process for preparing an electrostatographic imaging member according to claim 7 wherein said hydrolyzed aminosilane has the general formula:

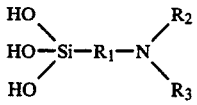

wherein $R_1$ is an alkylidene group containing 1 to 20 carbon atoms, and $R_2$ and $R_3$ are independently selected from the group consisting of H, a lower alkyl group containing 1 to 3 carbon atoms, a phenyl group and a poly(ethylene-amino)group.

15. A process for preparing an electrostatographic imaging member according to claim 7 including providing a substrate having a conductive surface, applying a thin coating of a reaction product of a hydrolyzed aminosilane on said conductive surface, forming said uniform dispersion, applying said dispersion to said thin coating to form a uniform layer of said dispersion, and drying said layer to form a photoconductive layer.

* * * * *